US007219789B2

(12) United States Patent
Hartley

(10) Patent No.: US 7,219,789 B2
(45) Date of Patent: May 22, 2007

(54) BAILING APPARATUS WITH HANDLE ORIENTER

(75) Inventor: Gary L. Hartley, North Fairfield, OH (US)

(73) Assignee: Berry Plastics Corporation, Evansville, IN (US)

( * ) Notice: Subject to any disclaimer, the term of this patent is extended or adjusted under 35 U.S.C. 154(b) by 261 days.

(21) Appl. No.: 10/909,639

(22) Filed: Aug. 2, 2004

(65) Prior Publication Data

US 2006/0021851 A1 Feb. 2, 2006

(51) Int. Cl.
*B65G 47/24* (2006.01)

(52) U.S. Cl. ..... 198/397.04; 198/393; 198/394; 198/396; 198/397.05; 198/400; 198/406; 198/412

(58) Field of Classification Search ..... 198/393, 198/394, 396, 397.04, 397.05, 400, 406, 198/412
See application file for complete search history.

(56) References Cited

U.S. PATENT DOCUMENTS 2,946,361 A * 7/1960 Skog et al. ..... 99/550
5,713,454 A * 2/1998 Jordan ..... 198/391
6,523,328 B1 * 2/2003 De Cardenas et al. ..... 53/399

OTHER PUBLICATIONS

Photo-Images of Infeed Device and Bailer (12 sheets) (Oct. 20, 2003).

* cited by examiner

*Primary Examiner*—Gene O. Crawford
*Assistant Examiner*—Leslie A. Nicholson, III
(74) *Attorney, Agent, or Firm*—Barnes & Thornburg LLP

(57) ABSTRACT

A bailing apparatus includes a bailer feeder and a bailer. The bailer feeder is arranged to feed handles to the bailer. The bailer is adapted to couple the handles to containers.

9 Claims, 8 Drawing Sheets

BAILING APPARATUS WITH HANDLE ORIENTER

BACKGROUND

The present disclosure relates to bailing apparatus for coupling handles to containers.

SUMMARY

According to the present disclosure, a bailing apparatus includes a bailer and a bailer feeder. The bailer couples handles to containers. The bailer feeder includes a handle orienter and an infeed device. The handle orienter orients handles that do not have a predetermined orientation so that the handles have the predetermined orientation and are delivered to the infeed device with the predetermined orientation. The infeed device feeds the oriented handles to the bailer.

In an illustrative embodiment of the disclosure, the handle orienter includes a lug orienter and a shaft orienter. The lug orienter orients a pair of lugs of each handle so the lugs extend downwardly from a shaft of the handle upon delivery of the handle to the shaft orienter by the lug orienter. When the lug orienter delivers a handle to the shaft orienter, the shaft of the handle is oblique to a shaft orientation axis. The shaft orienter orients the shaft so that it becomes perpendicular to the shaft orientation axis. Each handle is thus delivered to the infeed device with the predetermined orientation in which the lugs of the handle extend downwardly from the shaft of the handle and the shaft is perpendicular to the shaft orientation axis.

The lug orienter includes a bin formed to include a plurality of compartments rotatable about a compartment rotation axis. A bin shuttler is arranged to move the bin toward a rotatable wheel to a transfer position and away from the wheel to a retracted position. In the transfer position, a plurality of handle couplers coupled to the wheel for rotation with the wheel about a wheel rotation axis are arranged to pick up handles located in one of the compartments of the bin and to lay the picked-up handles down onto a moving belt included in the shaft orienter. In the retracted position, a compartment rotator rotates the compartments about the compartment rotation axis to provide more handles to the handle couplers upon return of the bin to the transfer position.

The shaft orienter includes the belt and a deck to which the belt is coupled. The deck includes first and second side walls and a diverging notch. The first side wall is positioned on one side of the belt and the second second side wall and the diverging notch are positioned on an opposite side of the belt. The first side wall is adapted to engage and guide a first of the lugs of each handle upon movement of the handle by the belt. The diverging notch extends away from the first side wall toward the second side wall to engage and guide a second of the lugs of each handle toward the second side wall upon movement of the handle by the belt.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which.

DETAILED DESCRIPTION

Figure 1:
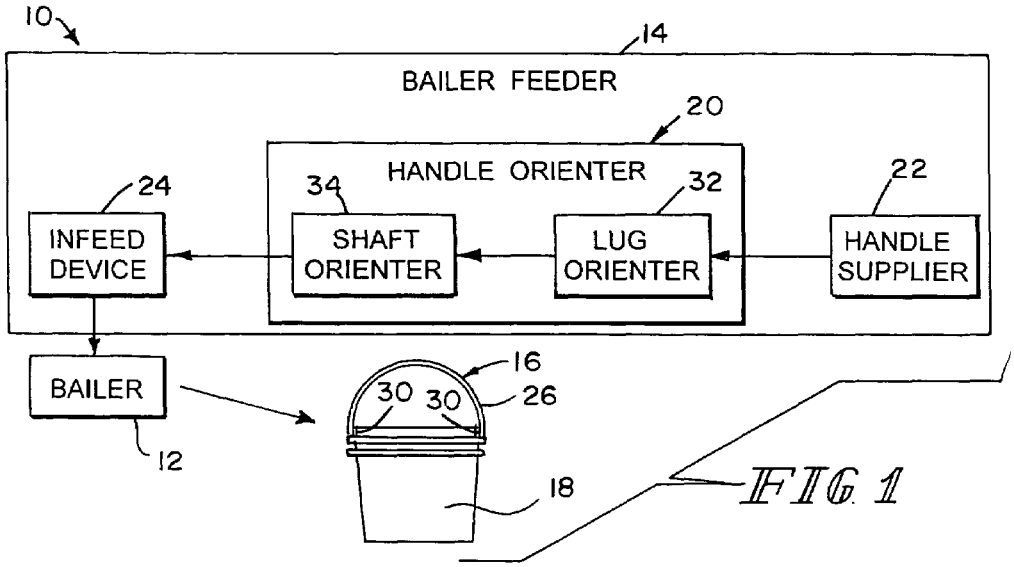
FIG. 1 is a diagrammatic view showing a bailing apparatus that includes a bailer feeder for feeding handles to a bailer which couples the handles to containers and showing a handle orienter that is included in the bailer feeder between a handle supplier and an infeed device to orient handles received from the handle supplier without a predetermined orientation to cause the handles to have the predetermined orientation upon delivery of the handles to the infeed device by the handle orienter.

A bailing apparatus 10 includes a bailer 12 and a bailer feeder 14, as shown diagrammatically, for example, in FIG. 1. Bailer 12 is adapted to couple handles 16 to containers 18. Bailer feeder 14 includes a handle orienter 20 arranged to orient handles received from a handle supplier 22 without a predetermined orientation so that handles 16 are delivered by handle orienter 20 with the predetermined orientation to an infeed device 24 which is arranged to feed handles 16 with the predetermined orientation to bailer 12. Handle orienter 20 thus provides handle orienter means for orienting handles 16 received from handle supplier 22 without the predetermined orientation to cause handles 16 to be delivered to infeed device 24 with the predetermined orientation in which shafts 26 included in handles 16 are perpendicular to a shaft orientation axis 28 and lugs 30 included in handles 16 and adapted to be coupled to containers 18 by bailer 12 extend away from shafts 26 in the same direction, as shown, for example, in FIGS. 2, 3, 9, 14, and 15.

Handle orienter 20 includes a lug orienter 32 and a shaft orienter 34, as shown diagrammatically, for example, in FIG. 1. Lug orienter 32 is arranged to orient a pair of lugs 30 that are included in each handle 16 for attachment to a container 18 and coupled to opposite ends of a shaft 26 included in handle 16 so that lugs 30 extend downwardly from shaft 26 upon delivery of handle 16 to shaft orienter 34 by lug orienter 32. Shaft orienter 34 is arranged to orient shaft 26 of each handle 16 so that shaft 26 is perpendicular to shaft orientation axis 28 along which shaft orienter 34 moves each handle 16 toward infeed device 24.

Figure 2:
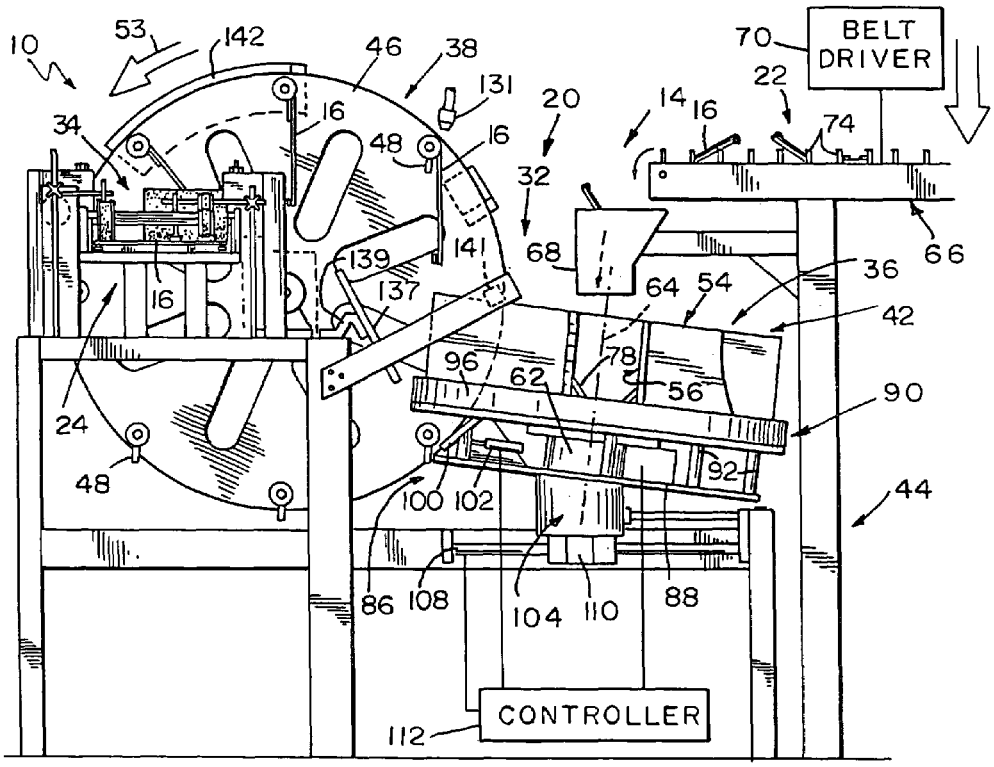
FIG. 2 is a side elevational view of the bailing apparatus showing the handle supplier supplying handles to a movable bin positioned in a transfer position adjacent a rotating wheel allowing a plurality of handle couplers coupled to the rotating wheel to pick up handles from the bin and lay down the picked-up handles onto a moving belt shown in FIG. 3.
Figure 3:
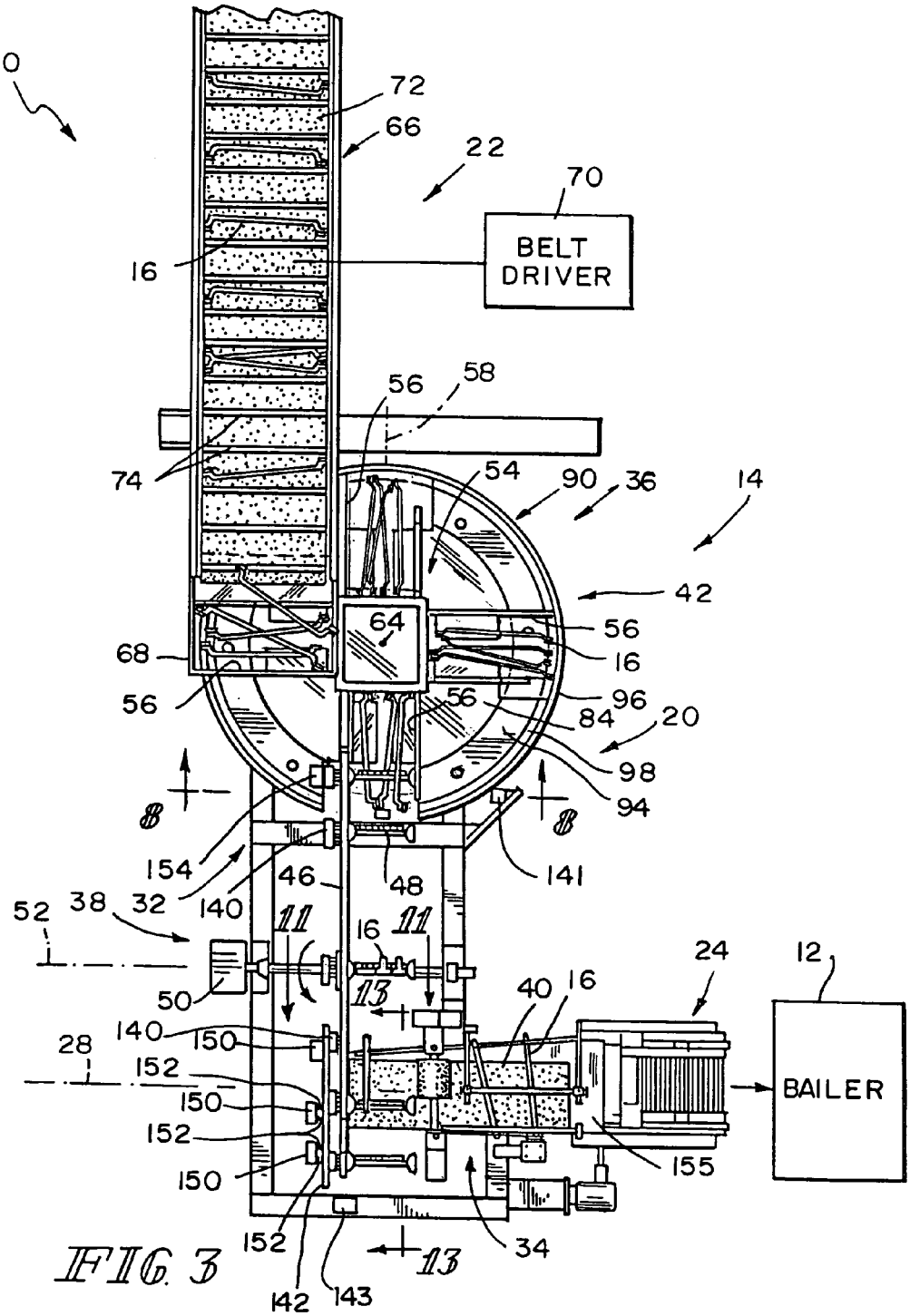
FIG. 3 is a top plan view of the bailing apparatus when the bin is in the transfer position.

Lug orienter 32 includes a sequencer 36 and a picker 38, as shown, for example, in FIGS. 2 and 3. Sequencer 36 is arranged to move groups of handles 16 received from handle supplier 22 in sequence into communication with picker 38. Picker 38 is arranged to pick up handles 16 from whichever group is in communication with picker 38 and to lay down the picked-up handles 16 onto a moving belt 40 included in shaft orienter 34 so that lugs 30 of handles 16 placed on belt 40 extend downwardly from shafts 26.

Sequencer 36 includes a bin 42 and a bin shuttler 44 and picker includes a rotatable wheel 46, a plurality of handle couplers 48 coupled to wheel 46, and a wheel rotator 50 (e.g., electric motor) arranged to rotate wheel 46 and handle couplers 48 coupled thereto about a wheel rotation axis 52 in a wheel rotation direction 53, as shown, for example, in FIGS. 2-6. Bin 42 includes a rotatable partition 54 formed to include a plurality of compartments 56 adapted to receive handles 16 from handle supplier 22. Bin shuttler 44 is arranged to move bin 42 along a shuttle axis 58 toward wheel 46 in a forward direction 59 (indicated in FIG. 6) to a transfer position shown, for example, in FIGS. 2 and 3 and away from wheel 46 in a rearward direction 61 to a retracted position shown, for example, in FIGS. 4 and 5.

In the transfer position, bin 42 is positioned adjacent wheel 46, as shown, for example, in FIGS. 2 and 3. An access opening 60 formed in bin 42 receives wheel 46 therein allowing handle couplers 48 coupled to wheel 46 for rotation therewith about axis 52 to pass upwardly through access opening 60 to pick up handles 16 from a compartment 56 in communication with handle couplers 48 and lay down the picked-up handles onto belt 40.

Figure 4:
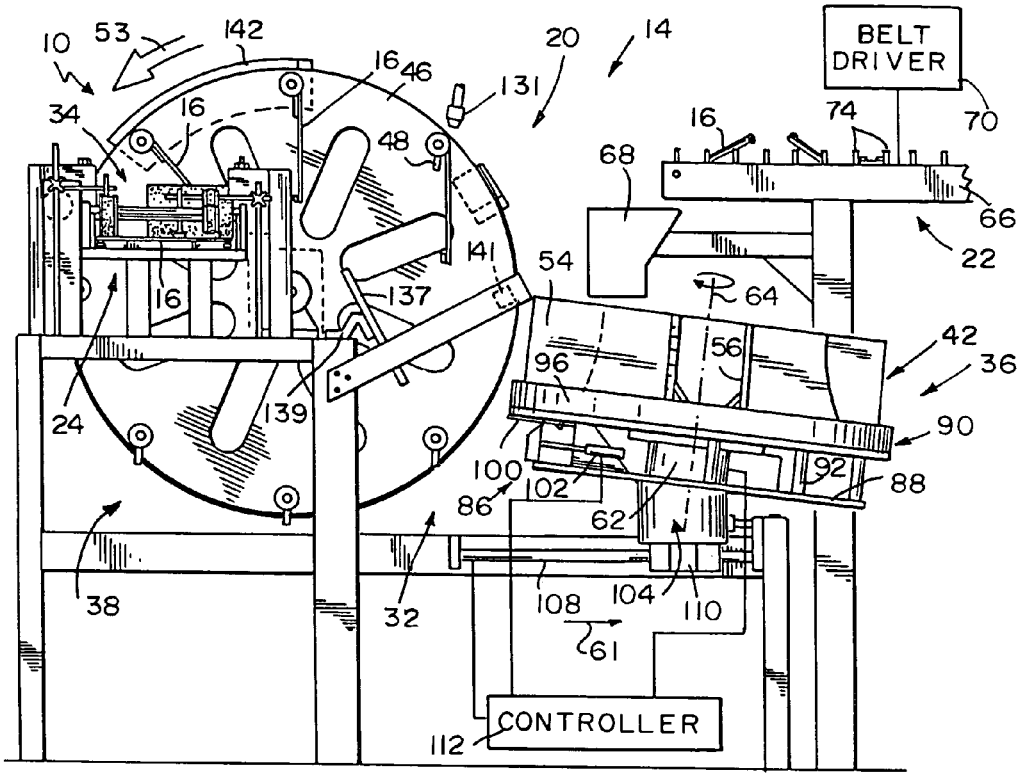
FIG. 4 is a side elevational view of the bailing apparatus showing the bin in a retracted position away from the rotating wheel allowing rotation of compartments included in the bin about a compartment rotation axis so that more handles can be provided to the handle couplers upon return of the bin to the transfer position.
Figure 5:
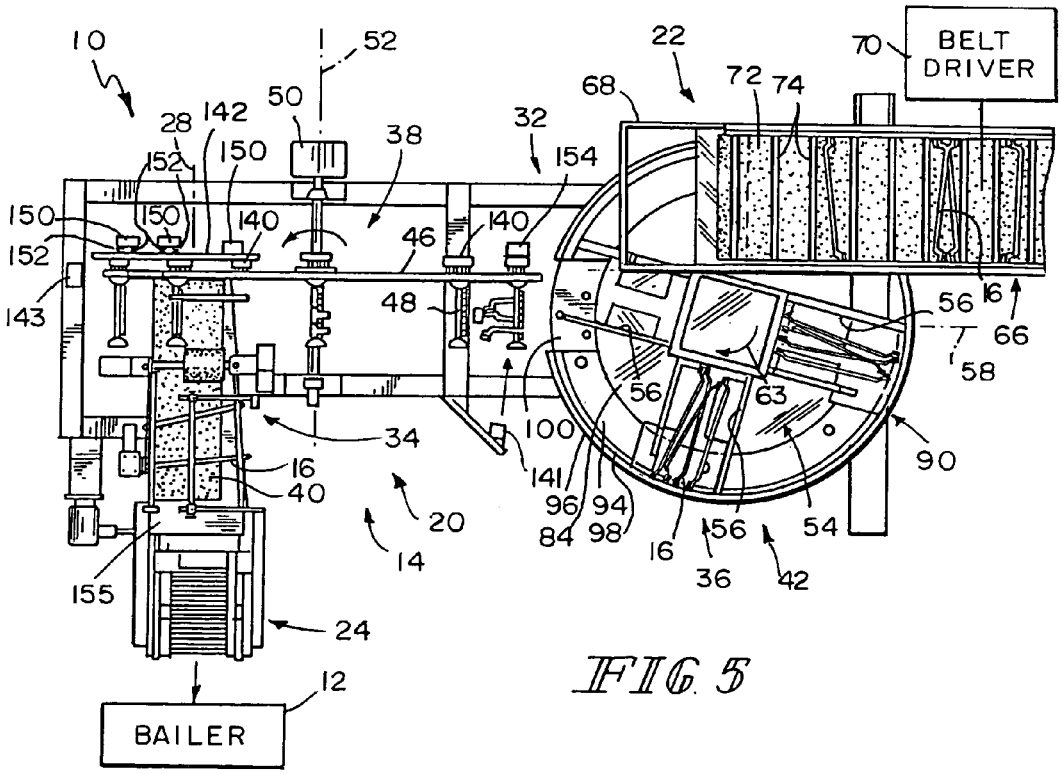
FIG. 5 is a top plan view of the bailing apparatus showing rotation of the compartments about the compartment rotation axis when the bin is positioned in the retracted position.

In the retracted position, bin 42 is positioned away from wheel 46, as shown, for example, in FIGS. 4 and 5. Wheel 46 is thereby positioned outside access opening 60 allowing a compartment rotator 62 (e.g., electric motor) coupled to partition 54 to rotate partition 54 and compartments 56 formed therein about a compartment rotation axis 64 in a compartment rotation direction 63 to position another compartment 56 containing more handles 16 in communication with handle couplers 48 upon return of bin 42 to the transfer position by bin shuttler 44.

Handle supplier 22 comprises a conveyor 66 and a chute 68, as shown, for example, in FIGS. 2-5. Conveyor 66 includes a belt driver 70 that drives a belt 72 to move handles 16 without the predetermined orientation toward chute 68. Dividers 74 on belt 72 facilitate movement of handles 16 by belt 72. At an end of conveyor 66, belt 72 drops handles 16 through chute 68 which guides the falling handles 16 into an underlying compartment 56 not in communication with handle couplers 48 when bin 42 is positioned in the transfer position.

Compartments 56 are spaced about compartment rotation axis 64, as shown, for example, in FIGS. 3 and 5. Illustratively, there are four compartments 56 spaced at 90° intervals about axis 64.

Figure 7:
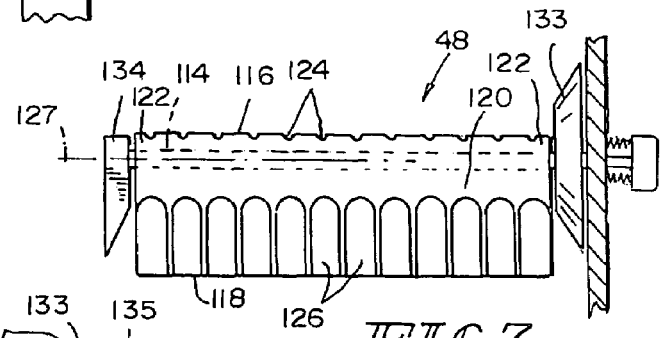
FIG. 7 is a front elevational view of one of the handle couplers.

Each compartment 56 includes a pair of spaced-apart side walls 76 and a pair of spaced-apart guide walls 78, 80, as shown, for example, in FIG. 7. A floor 82 of each compartment 56 is provided by a disk 84 of partition 54. Guide walls 78, 80 are arranged to guide handles 16 dropped into compartment 56 from conveyor 66 into a space defined between guide walls 78, 80. Guide walls 78, 80 are inclined at angles different from one another to cause handles 16 dropped into compartment 56 to tend to tumble so that lugs 30 extend generally downwardly from shafts 26 when handles 16 come to rest in compartment 56 to facilitate coupling of handles 16 to handle couplers 48.

Figure 6:
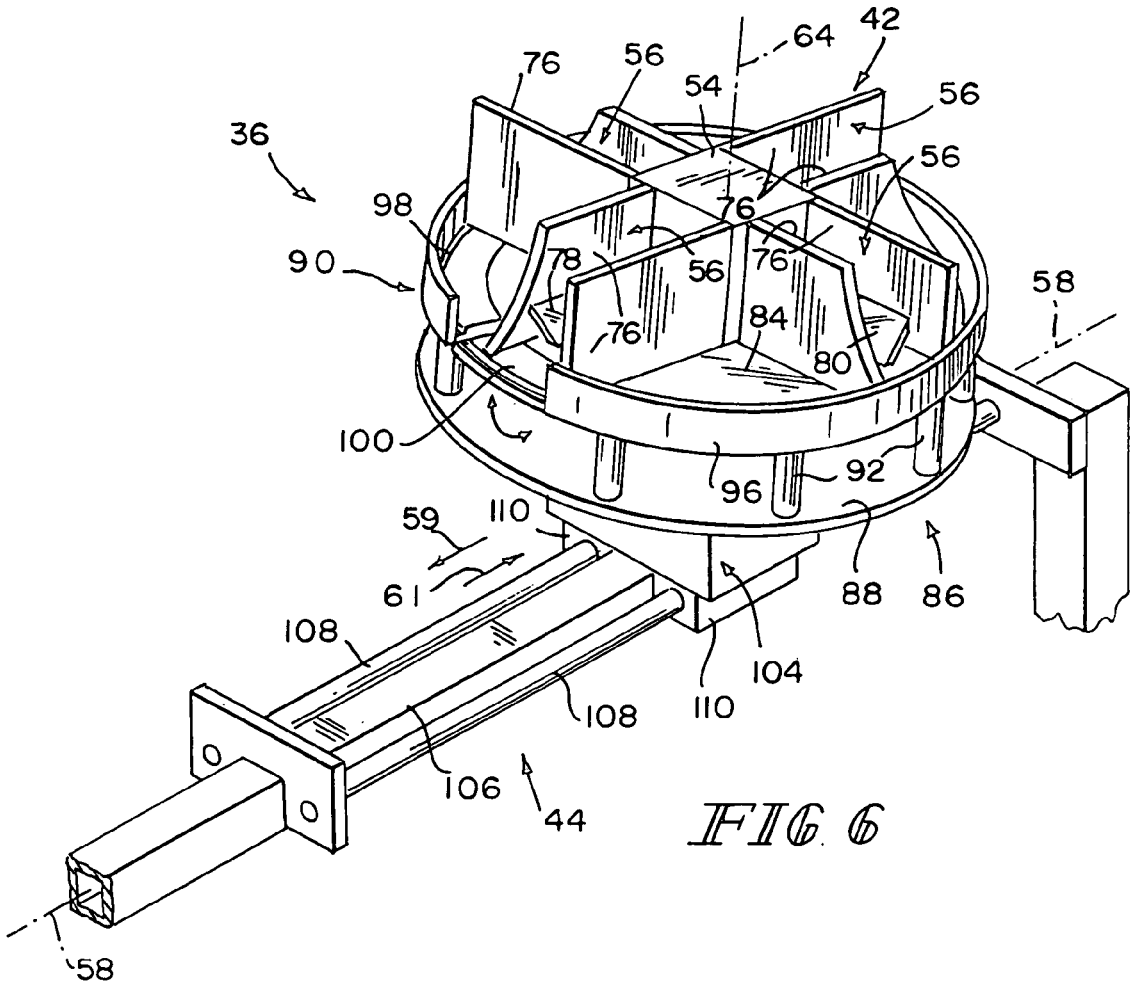
FIG. 6 is a perspective view showing the bin coupled to a bin shuttler arranged to move the bin back and forth along a shuttle axis between the transfer and retracted positions.

Bin 42 includes a frame 86 that supports partition 54 and compartment rotator 62, as shown, for example, in FIGS. 2, 4, and 6. Frame 86 includes a lower plate 88, an upper retainer 90, and a plurality of struts 92 connecting plate 88 and retainer 90 to support retainer 90 above plate 88.

Retainer 90 partially surrounds partition 54 and compartments 56 formed therein to retain handles 16 in compartments 56 upon rotation of compartments 56 about compartment rotation axis 64, as shown, for example, in FIGS. 3 and 4. Retainer 90 is formed to include access opening 60. Retainer 90 includes a bottom wall 94 and a perimeter wall 96 coupled to and extending upwardly from the perimeter of bottom wall 94. Walls 94, 96 cooperate to provide access opening 60 and cooperate to provide a perimeter groove 98 adapted to receive one of lugs 30 of handles 16 in compartments 56 so that lugs 30 will be extending generally downwardly when they are placed in communication with handle couplers 48 to facilitate coupling of handles 16 to handle couplers 48.

Bin 42 includes a closure 100 and a closure mover 102, as shown, for example, in FIGS. 2 and 4-8. Closure mover 102 (e.g., air cylinder) is coupled to closure 100 and arranged to move closure between an opened position opening access opening 60 when bin 42 is positioned in the transfer position, as shown, for example, in FIGS. 2, 3, and 7, and a closed position closing access opening 60 when bin 42 is positioned in the retracted position, as shown, for example, in FIGS. 5 and 6.

Bin shuttler includes an inclined bin support 104, as shown, for example, in FIGS. 2, 4, and 6. Support 104 underlies lower plate 88 and is coupled thereto to support bin 42 in an inclined position to facilitate transfer of handles 16 to handle couplers 48. Illustratively, support 104 inclines bin 42 at an angle of about 7° with respect to a horizontal reference plane as suggested FIGS. 2, 4, and 6.

Bin shuttler 44 includes a driver 106 and a pair of parallel rails 108, as shown, for example, in FIGS. 2, 4, and 6. Support 104 includes a pair of feet 110. Each foot 110 receives one of rails 108 to slide thereon. Driver 106 is coupled to support 104 to cause feet 110 to slide on rails 108 and thus cause movement of bin 42 between the transfer and retracted positions. Driver 106 is configured, for example, as an air cylinder (e.g., model number SLM-40-550-KF-A-S-G-CV available from Festo Corp. of Hauppauge, N.Y.).

Bailer feeder 14 includes an electronic controller 112, as shown, for example, in FIGS. 2 and 4. Controller 112 is coupled to driver 106, compartment rotator 62, and closure mover 102 to coordinate movement of bin 42 between the transfer and retracted positions, rotation of compartments 56 about compartment rotation axis 64, and movement of closure 100 between the opened and closed positions.

Figure 8:
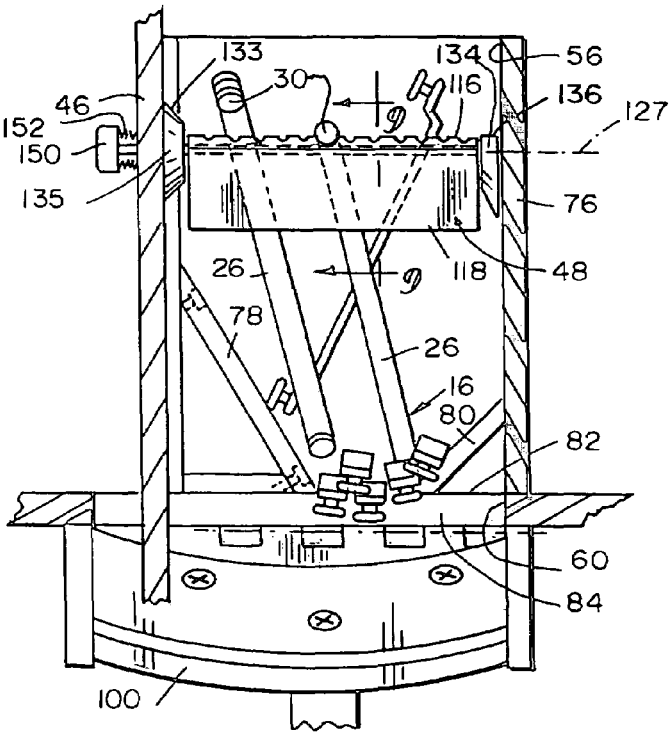
FIG. 8 is a sectional view taken along lines 8-8 of FIG. 3 showing one of the handle couplers picking up handles from a compartment included in the bin.
Figure 9:
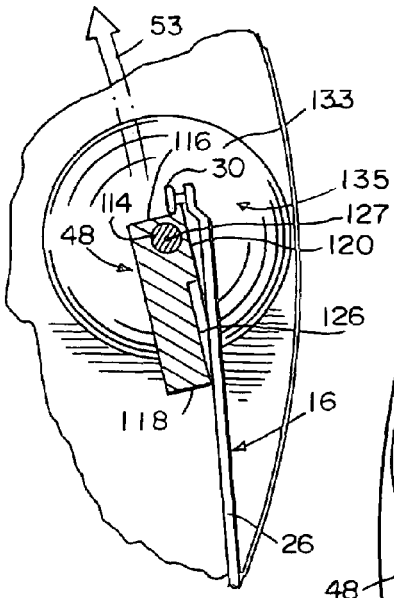
FIG. 9 is a sectional view taken along lines 9-9 of FIG. 8 showing one of the handle couplers carrying a handle upon rotation of the wheel.

Each handle coupler 48 is configured, for example, as a plate coupled to an axle 114 fixed to wheel 46, as shown, for example, in FIGS. 7-9. Coupler 48 includes a top portion 116, a bottom portion 118, and a side portion 120 extending between top and bottom portions 116, 118. Top, bottom, and side portions 116, 118, 120 extend between opposite end portions 122 of coupler 48.

A plurality of lug receivers 124 for receiving lugs 30 are formed in and aligned along top portion 116 between end portions 122 of coupler 48, as shown, for example, in FIGS. 7-9. illustratively, each lug receiver 124 is a notch formed in top portion 116 of handle coupler 48.

A plurality of shaft receivers 126 for receiving shafts 26 are formed in and aligned along side portion 120 between end portions 122, as shown, for example, in FIGS. 7 and 9. Illustratively, each shaft receiver 126 is a groove formed in side portion 120. It is within the scope of this disclosure for the depths of adjacent receivers 126 to be different from one another (e.g., to alternate between first and second depth]s). It is further within the scope of this disclosure for receivers 126 to be formed as grooves that extend all the way through handle coupler 48.

Figure 10:
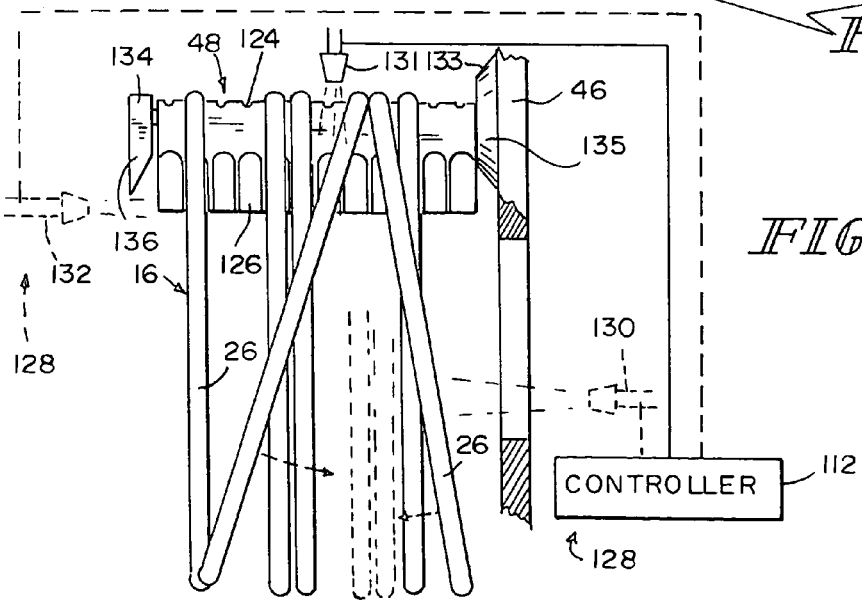
FIG. 10 is a front elevational view showing a handle disconnector configured, for example, as two vertically spaced air pulsers arranged on opposite sides of the wheel to direct pulses of air at handles carried by the handle couplers to disconnect any handles that may have inadvertently become criss-crossed or otherwise connected.

Lug receivers 124 and shaft receivers 126 are arranged in pairs so that the lug receiver 124 and shaft receiver 126 of each pair cooperate to position a handle 16 received by the pair in generally perpendicular relation to a coupler axis 127 of coupler 48 to pre-position handle 16 to be laid down onto belt 40, as suggested, for example, in FIGS. 8-10. The receiver pairs thus act to position the handles 16 coupled to coupler 48 in generally parallel relation. Inclined guide surfaces 133, 134 formed in plates 135, 136 located adjacent end portions 122 are arranged to guide handles 16 toward the lug receiver/shaft receiver pairs.

During an attempted transfer of handles 16 from a compartment 56 to a handle coupler 48, handle coupler 48 moves against handles 16 in compartment 56 to promote coupling of lugs 30 to lug receivers 124. A guide plate 137 is arranged to guide handles 16 which do not successfully couple to handle coupler 48 back into compartment 56. An air pulser 139 coupled to guide plate 137 and under the control of controller 112 is arranged to direct a pulse of air at handles 16 falling back into compartment 56 to promote tumbling of such handles 16 in compartment 56 so that such handles 16 will come to rest in compartment 56 with their lugs 30 extending generally downwardly. A coupler sensor 141 (e.g., a photosensor) is arranged to sense each handle coupler 48 that passes sensor 141 and is coupled to controller 112 to inform controller 112 when a handle coupler 48 has passed sensor 141. Controller 112 uses this information from sensor 141 to cause air pulser 139 to generate a pulse of air each time that sensor 141 senses a handle coupler 48.

Handles 16 which are coupled to a handle coupler 48 may become criss-crossed or otherwise connected to one another due to, for example, a lug 30 of one handle 16 becoming caught on the shaft 26 of a nearby handle 16, as suggested, for example, in FIG. 10. A handle disconnector 128 is arranged to disconnect such handles 16 that have become connected to one another to facilitate laying those handles 16 down onto belt 40 in a manner conducive to delivering handles 16 to infeed device 24 in the predetermined orientation.

In one example, handle disconnector 128 includes a pair of vertically-spaced side air pulsers 130, 132 located on opposite sides of wheel 46, as shown, for example, in FIG. 10. Each air pulser 130, 132 is arranged to direct a horizontal pulse of air at handles 16 coupled to each handle coupler 48 as handles 16 pass air pulsers 130, 132. Such pulses of air cause handles 16 to vibrate somewhat to facilitate disconnection of handles 16 that have become connected. Air pulser 130 is used to disconnect a handle 16 crossing another handle 16 in one direction and air pulser 132 is used to disconnect a handle 16 crossing another handle 16 in an opposite direction. Controller 112 is coupled to air pulsers 130, 132 to time the air pulses released therefrom at passing handles 16. Controller 112 causes air pulser 130 to discharge pulses of air through openings 134 formed in wheel 46. It is within the scope of this disclosure to include a coupler sensor (not shown) configured, for example, as a photosensor and associated with each air pulser 130, 132 to sense each handle coupler 48 that passes it and to send this information to controller 112. Controller 112 uses this information from the coupler sensors to control operation of air pulsers 130, 132.

In another example, handle disconnector 128 includes a single top air pulser 131, as shown, for example, in FIG. 10. Pulser 131 is arranged to direct a downward pulse of air at handles 16 on each handle coupler 48 to disconnect criss-crossed or otherwise connected handles 16. Controller 112 is coupled to pulser 131 and a brake sensor 143 (e.g., a photosensor) to activate pulser 131 each time that brake sensor 143 senses a brake 140 which is coupled to wheel 46 and discussed in more detail herein.

Each handle coupler 48 is mounted to an axle 114 normally for rotation about a coupler axis 127 established by an axle 114 upon rotation of wheel 46 about wheel rotation axis 52. Handle coupler 48 is thus normally in a generally vertical orientation to facilitate picking up handles 16 from compartments 56.

Figure 11:
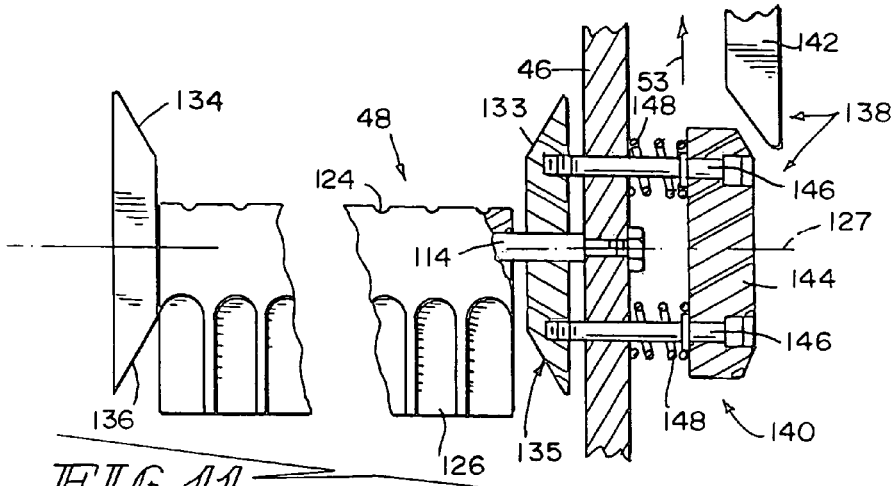
FIG. 11 is a sectional view taken along lines 11-11 of FIG. 3 showing a brake of an anti-coupler-rotation device coupled to one of the handle couplers and positioned normally in a rotation-enabling position allowing rotation of the handle coupler about a coupler axis.
Figure 12:
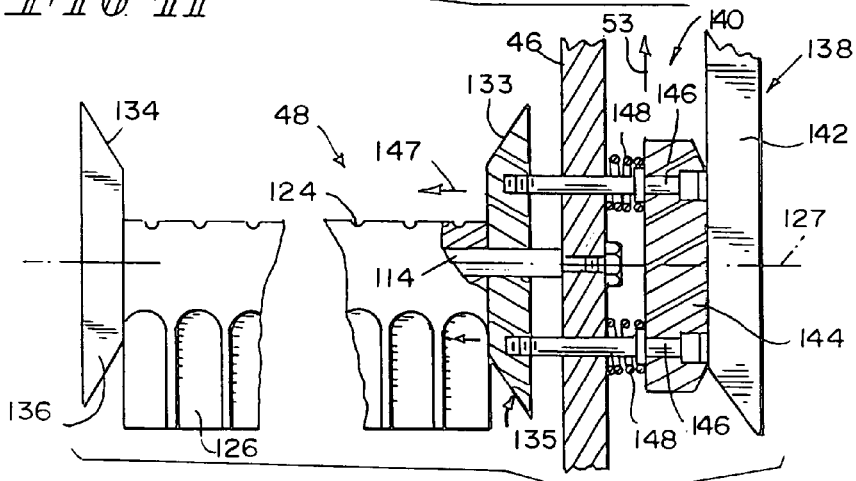
FIG. 12 is a sectional view similar to FIG. 11 showing the brake in a rotation-blocking position blocking rotation of the handle coupler about the coupler axis upon sliding engagement between the brake and a brake actuator.

A first anti-coupler-rotation device 138 shown, for example, in FIGS. 11 and 12 is arranged to block rotation of each coupler 48 about its coupler axis 127 during rotation of handle coupler 48 with wheel 46 through an arc about wheel rotation axis 52 to lower handles 16 coupled to handle coupler 48 toward and onto moving belt 40. In this way, handle coupler 48 and any handles 16 coupled thereto will become somewhat horizontal as handle coupler 48 rotates with wheel 46 through the arc to facilitate laying handles 16 down onto moving belt 40.

Figure 13:
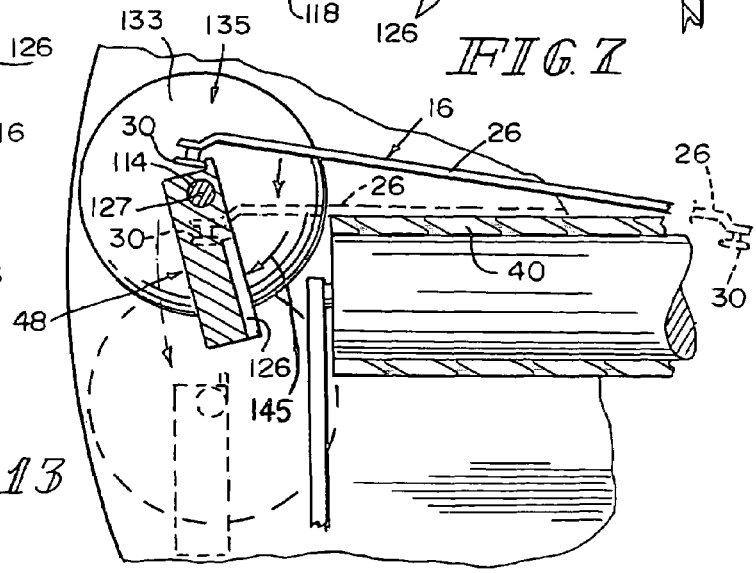
FIG. 13 is a sectional view taken along lines 13-13 of FIG. 3 showing a handle coupler laying a handle down onto a moving belt so that two lugs coupled to opposite ends of a shaft of the handle and used to couple the handle to a container extend downwardly from the shaft.

Device 138 includes a plurality of coupler brakes 140 coupled to wheel 46 and a first brake actuator 142 for actuating brakes 140, as shown, for example, in FIGS. 11 and 12 with respect to one coupler brake 138. Each brake 138 is associated with one of handle couplers 48 and arranged to move relative thereto between a normal rotation-enabling position allowing rotation of handle coupler 48 about axis 127, as shown, for example, in FIG. 11, and a rotation-blocking position blocking rotation of handle coupler 48 about axis 127, as shown, for example, in FIG. 12. Brake actuator 142 is arranged to move brake 138 from the rotation-enabling position to the rotation-blocking position when brake 138 engages brake actuator 142. Brake 138 remains in the rotation-blocking position as it travels through the arc which is established by brake actuator 142. Brake 138 disengages brake actuator 142 and returns to the rotation-enabling position at the end of the arc. Handle coupler 48 rotates in a direction 145 shown, for example, in FIG. 13 to lay handles 16 coupled thereto down onto belt 40 when brake 138 disengages brake actuator 142.

Illustratively, each brake 140 includes a pressure plate 135, a slide plate 144, and a pair of connector bolts 146 extending through wheel 46 and connecting plates 135, 144, as shown, for example, in FIGS. 11 and 12. A spring 148 surrounding each bolt 146 and located between slide plate 144 and wheel 46 biases brake 140 toward its rotation-enabling position. Brake actuator 142 is configured, for example, as a striker plate arranged to engage slide plate 144 to cause brake 140 to move from its rotation-enabling position to its rotation-blocking position in a braking direction 147. Sliding engagement between actuator 142 and slide plate 144 causes slide plate 144 to move toward wheel 46 against a biasing force generated by springs 148. This motion of slide plate 144 is transmitted through bolts 146 to pressure plate 135 which contacts an end portion 122 of coupler 48 to sandwich coupler 48 between plates 135, 136 to thereby block rotation of coupler 48 about axis 127. Springs 148 return brake 140 to the rotation-enabling position upon disengagement between slide plate 144 and actuator 142. It is within the scope of this disclosure to place a spring between coupler 48 and plate 136 to accommodate component tolerances.

Brake actuator 142 is coupled to a number (e.g., three) of actuator mount posts 150, as shown, for example, in FIGS. 3 and 5. A pair of springs 152 is positioned between brake actuator 142 and two of posts 150 to allow movement of actuator 142 during contact with slide plate 144.

A second brake actuator 154 shown, for example, in FIGS. 3 and 5 is arranged to engage brakes 140 before first brake actuator 142 engages brakes 140. Coupler 48 may tend to rock back and forth about its axis 127 when it picks up handles 16 from a compartment 56. Brake actuator 154 is positioned to actuate each brake 140 briefly to stop such rocking and associated swinging of handles 16 coupled to coupler 48. Second brake actuator 154 is configured, for example, as a striker plate that is smaller than the striker plate of first brake actuator 142.

Figure 14:
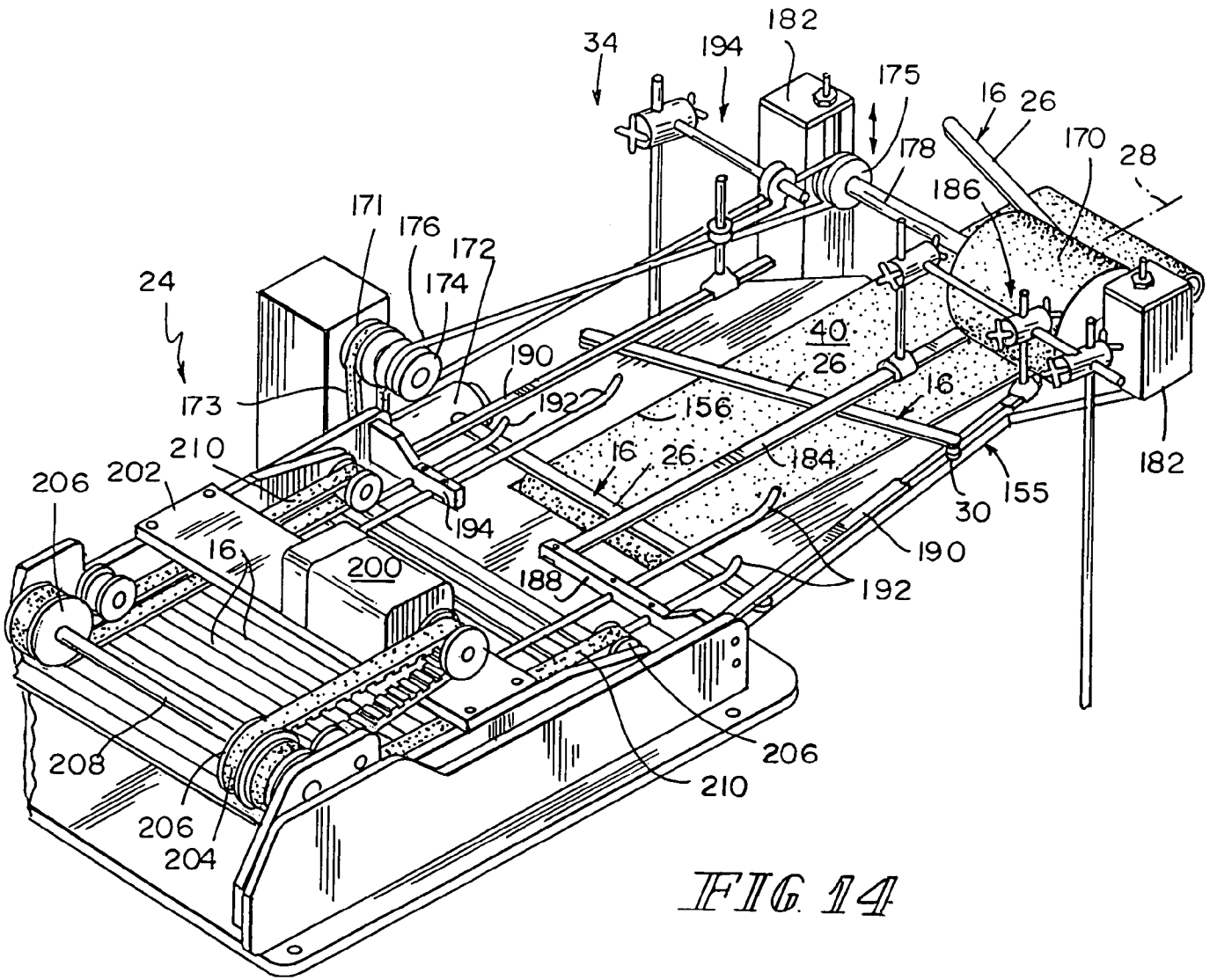
FIG. 14 is a perspective view showing a shaft orienter that is included in the handle orienter and includes the moving belt and a deck formed to include an orientation adjuster adapted to adjust the orientation of the shafts of handles placed on the belt so that the shafts become perpendicular to a shaft orientation axis along which the belt moves the handles toward the infeed device.
Figures 15, 16:
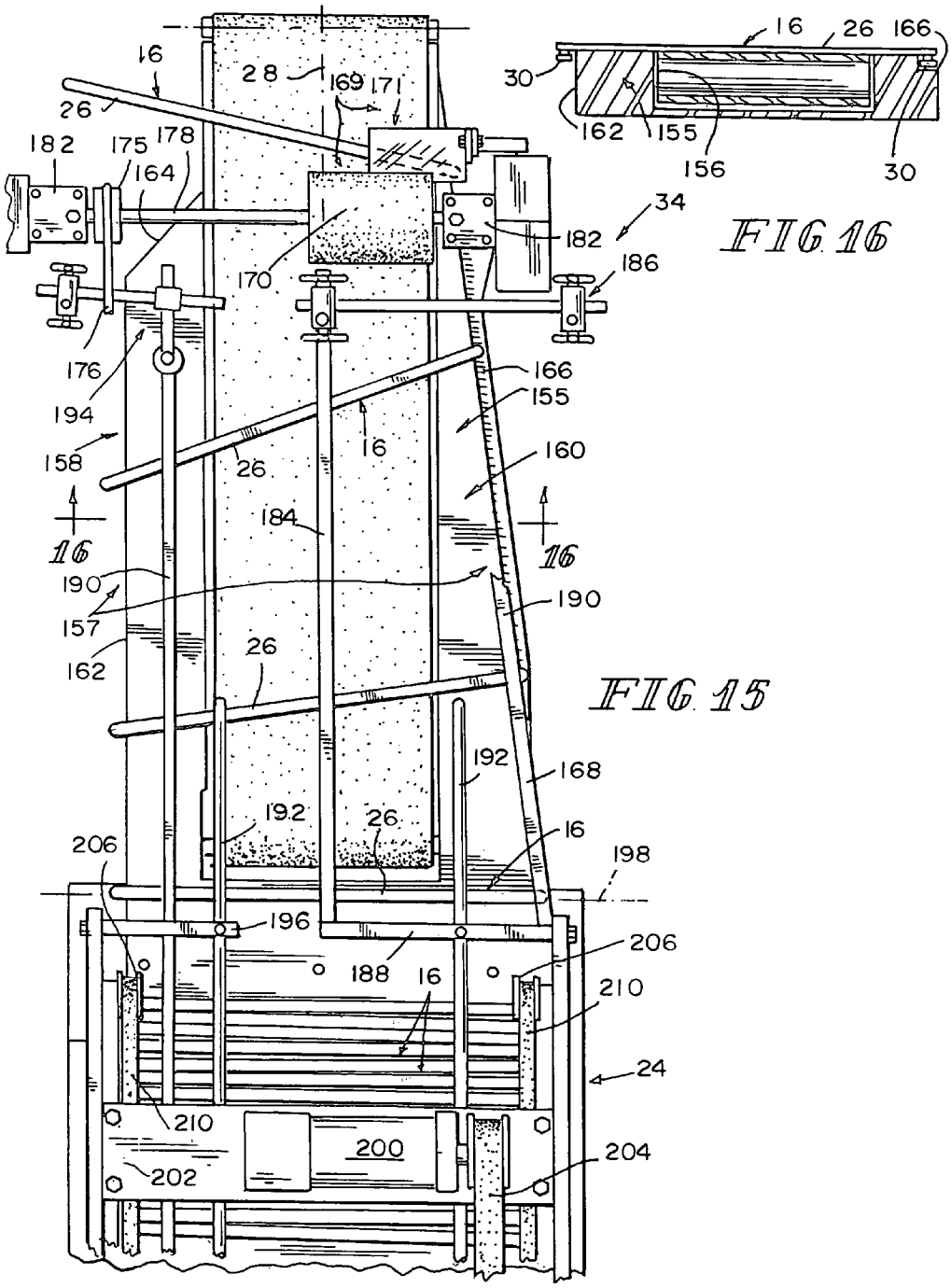
FIG. 15 is a top plan view showing adjustment of the orientation of the shafts of handles placed on the belt upon movement of the handles along the orientation adjuster by use of the moving belt so that the handles are delivered to the infeed device with the predetermined orientation in which the lugs of each handle extend downwardly from the shaft of the handle and the shaft is perpendicular to the orientation axis.
FIG. 16 is a sectional view taken along lines 16-16 of FIG. 15 showing the orientation adjuster including a side wall of the deck on one side (left side) of the belt for engaging and guiding a first lug of each handle upon movement of the handle by the belt and a notch formed in the deck on an opposite side (right side) of the belt for engaging and guiding a second lug of each handle upon movement of the handle by the belt.

Belt 40 is coupled to a deck 155 of shaft orienter 34, as shown, for example, in FIGS. 14-16. Belt 40 is positioned in an opening 156 formed in deck 155.

Handle couplers 48 release handles 16 onto moving belt 40. When released, lugs 30 extend downwardly from shafts 26. However, because belt 40 is moving, shafts 26 of handles 16 are oblique to shaft orientation axis 28 upon release from handle couplers 48.

An orientation adjuster 157 included in shaft orienter 34 is arranged to adjust the orientation of each handle 16 received on belt 40 upon movement of belt 40 toward infeed device 24 so that each shaft 26 becomes perpendicular to shaft orientation axis 28 for delivery to infeed device 24, as shown, for example, in FIGS. 14-16. Adjuster 157 includes a first lug guide 158 and a second lug guide 160. Lug guides 158, 160 are positioned on opposite sides of belt 40. First lug guide 158 is arranged to engage and guide movement of a first lug 30 of each handle 16 upon movement of handle 16 by belt 40 along axis 28. Second lug guide 160 is arranged to engage and guide movement of a second lug 30 of each handle 16 upon movement of handle 16 by belt 40 along axis 28.

First lug guide 158 includes a first side wall 162 of deck 155 and a diverging wall 164 of deck 155, as shown, for example, in FIG. 15. Wall 164 diverges outwardly toward first side wall 162 to guide a first lug 30 of each handle 16 thereto.

Second lug guide 160 includes a diverging notch 166 formed in deck 155 and a second side wall 168 parallel to first side wall 162, as shown, for example, in FIGS. 14-16. Notch 166 diverges away from first side wall 162 toward second side wall 168 to receive and guide a second lug 30 of each handle 16 toward second side wall 168.

A motion facilitator 169 is arranged to facilitate entry of second lug 30 into notch 166, as shown, for example, in FIGS. 14 and 15. Motion facilitator 169 includes an inclined plate 171 and a roller 170. Plate 171 is inclined relative to a horizontal reference plane and is positioned in front of roller 170 to push shafts 26 (which may bowed somewhat upwardly) downward toward belt 40 so that handles 16 can pass under roller 170. Roller 170 is arranged to hold each handle 16 down on belt 40 and cooperates with belt 40 to move handle 16 forward along axis 28 so that second lug 30 enters into notch 166.

A driver 172 (e.g., electric motor) is used to move roller 170 and belt 40 at the same speed. Driver 172 is arranged to rotate roller 170 through a belt 173 that connects a pair of pulleys 171 (one shown in FIG. 14), a belt 176 that connects a pair of pulleys 174, 175, and a roller axle 178 that connects pulley 175 and roller 170. A pair of mounts 182 are arranged to mount roller 170, roller axle 178, and pulley 175. Illustratively, pulleys 174, 175 are mounted so that belt 176 is positioned outwardly from a post 177. It is within the scope of this disclosure for pulleys 174, 175 to be mounted so that belt 176 is positioned inwardly from post 177. It is further within the scope of this disclosure to include a spring in each mount 182 to allow vertical movement of roller 170 in response to movement of handles 16 between roller 170 and belt 40.

An anti-slip rail 184 extends over and along belt 40, as shown, for example, in FIGS. 14 and 15. Rail 184 holds handles 16 down in contact with belt 40 to prevent handles 16 from slipping thereon so that handles 16 move with belt 40 along axis 28. Opposite ends of rail 184 are coupled to first and second rail mounts 186, 188.

Outer anti-handle-rotation rails 190 and inner anti-handle-rotation rails 192 are coupled to first and second rail mounts 186, 188 and third and fourth rail mounts 194, 196, as shown, for example, in FIGS. 14 and 15. Rails 190, 192 are arranged to block rotation of each handle 16 about its longitudinal axis 198 upon movement of handle 16 by belt 40 along axis 28. Rails 190, 192 and mounts 186, 188, 190, 192 thus cooperate to provide an anti-handle-rotation device.

Infeed device 24 is arranged to move handles 16 received from shaft orienter 34 with the predetermined orientation along axis 28 to feed handles 16 to bailer 12. Illustratively, infeed device 24 is available from Albright Machine located in Monroeville, Ohio and has model number 808-1005-A. Infeed device 24 includes a driver 200 (e.g., electric motor) coupled to a driver mount plate 202. Driver 200 rotates a drive belt 204 which acts through pulleys 206 and a pulley axle 208 to cause rotation of side belts 206 surrounding pulleys 206 to move handles 16 with the predetermined orientation along axis 28 toward bailer 12 for transfer thereto. An example of bailer 12 is available from Albright Machine also and has model number 808.

The invention claimed is:

1. A bailing apparatus comprising a bailer adapted to couple a handle having a shaft and a lug to a container and a bailer feeder including a handle supplier adapted to supply a handle without a predetermined orientation, an infeed device arranged to feed a handle with a predetermined orientation to the bailer, and handle orienter means for orienting the handle received from the handle supplier without the predetermined orientation to cause the handle to be delivered to the infeed device with the predetermined orientation so that the shaft is perpendicular to a shaft orientation axis and the lug is adapted to be coupled to the container by the bailer and extends away from the shaft.

2. The bailing apparatus of claim 1, wherein the handle orienter means includes a lug orienter and a shaft orienter, the lug orienter is arranged to orient a pair of lugs that are included in each handle for attachment to a container and coupled to opposite ends of a shaft included in the handle so that the lugs extend downwardly from the shaft upon delivery of the handle to the shaft orienter by the lug orienter, and the shaft orienter is arranged to orient the shaft of each handle so that the shaft is perpendicular to the shaft orientation axis along which the shaft orienter moves each handle toward the infeed device.

3. The bailing apparatus of claim 2, wherein the lug orienter includes a sequencer and a picker, the sequencer is arranged to move groups of handles received from the handle supplier in sequence into communication with the picker, the picker is arranged to pick up handles from whichever group is in communication with the picker and to lay down the picked-up handles onto a belt included in the shaft orienter so that the lugs of the handles placed on the belt extend downwardly.

4. The bailing apparatus of claim 2, wherein the shaft orienter includes a deck and a belt coupled to the deck and arranged to move the handles positioned thereon by the lug orienter toward the infeed device, the deck includes first and second side walls that are spaced apart from and parallel to one another, the deck is formed to include a diverging notch diverging away from the first side wall to the second side wall, and, when the belt moves the handles toward the infeed device, the first side wall is adapted to engage a first of the lugs of each handle and the diverging notch is adapted to receive a second of the lugs of each handle to guide the second lug toward the second side wall to cause the shafts of the handles to become perpendicular to the shaft orientation axis.

5. The bailing apparatus of claim 1, wherein the handle orienter means includes a compartment rotator and a plurality of compartments adapted to receive handles from the handle supplier and spaced circumferentially about a compartment rotation axis for rotation about the compartment rotation axis by the compartment rotator.

6. The bailing apparatus of claim 1, wherein the handle orienter means includes a belt, a wheel arranged to rotate about a wheel rotation axis, and a plurality of handle couplers coupled to the wheel and spaced circumferentially about the wheel rotation axis to couple to the handles and release the handles onto the belt.

7. The bailing apparatus of claim 1, wherein the handle orienter means includes a side wall and a belt and is formed to include a diverging notch, the belt is arranged to move handles positioned thereon toward the infeed device, the diverging notch diverges away from the side wall, and, when the belt moves the handles toward the infeed device, the side wall is adapted to engage a first lug of each handle and the diverging notch is adapted to receive and engage a second lug of each handle to cause a shaft of each handle to become perpendicular to the shaft orientation axis along which the belt moves the handles toward the infeed device.

8. A bailing apparatus comprising a bailer adapted to couple handles to containers and a bailer feeder including a handle supplier adapted to supply handles without a predetermined orientation, an infeed device arranged to feed handles with the predetermined orientation to the bailer, and handle orienter means for orienting handles received from the handle supplier without the predetermined orientation to cause the handles to be delivered to the infeed device with the predetermined orientation in which shafts included in the handles are perpendicular to a shaft orientation axis and lugs included in the handles and adapted to be coupled to the containers by the bailer extend away from the shafts wherein the handle orienter means includes a lug orienter and a shaft orienter, the lug orienter is arranged to orient a pair of lugs that are included in each handle for attachment to a container and coupled to opposite ends of a shaft included in the handle so that the lugs extend downwardly from the shaft upon delivery of the handle to the shaft orienter by the lug orienter, and the shaft orienter is arranged to orient the shaft of each handle so that the shaft is perpendicular to the shaft orientation axis along which the shaft orienter moves each handle toward the infeed device wherein the lug orienter includes a sequencer and a picker, the sequencer is arranged to move groups of handles received from the handle supplier in sequence into communication with the picker, the picker is arranged to pick up handles from whichever group is in communication with the picker and to lay down the picked-up handles onto a belt included in the shaft orienter so that the lugs of the handles placed on the belt extend downwardly wherein the sequencer includes a bin and a bin shuttler, the bin is formed to include a plurality of compartments adapted to receive handles from the handle supplier and a compartment rotator, the picker includes a rotatable wheel, a plurality of handle couplers coupled to the wheel, and a wheel rotator arranged to rotate the wheel and the handle couplers coupled thereto about a wheel rotation axis, the bin shuttler is arranged to move the bin along a shuttle axis toward the wheel to a transfer position and away from the wheel to a retracted position, the wheel is positioned to rotate about the wheel rotation axis in an access opening formed in the bin allowing the handle couplers to pass through the access opening to pick up handles from one of the compartments and lay down the picked-up handles onto the belt of the shaft orienter when the bin is positioned in the transfer position, and the wheel is positioned outside the access opening allowing the compartment rotator to rotate the compartments about a compartment rotation axis when the bin is positioned in the retracted position.

9. The bailing apparatus of claim 8, wherein the handle orienter means includes a controller coupled to the bin shuttler and the compartment rotator to coordinate movement of the bin between the transfer and refracted positions and rotation of the compartments.

* * * * *